US006126304A

United States Patent [19]

Gotoh et al.

[11] Patent Number: 6,126,304

[45] Date of Patent: Oct. 3, 2000

[54] VEHICULAR LAMP

[75] Inventors: Takayoshi Gotoh; Tamaaki Sugiura, both of Shimizu, Japan

[73] Assignee: Koito Manufacturing Co., Ltd., Tokyo, Japan

[21] Appl. No.: 09/179,844

[22] Filed: Oct. 28, 1998

[30] Foreign Application Priority Data

Oct. 28, 1997 [JP] Japan ..... 9-295224

[51] Int. Cl.[7] ..... F21M 3/00

[52] U.S. Cl. ..... 362/546; 362/476; 362/507; 362/509; 362/523; 362/527; 362/61

[58] Field of Search ..... 362/546, 476, 362/507, 509, 523, 527, 61

[56] References Cited

U.S. PATENT DOCUMENTS 5,448,454 9/1995 Nonaka ..... 362/61

5,934,799 8/1999 Suzuki et al. ..... 362/507

*Primary Examiner*—Mohammad Y. Sikder

*Attorney, Agent, or Firm*—Sughrue, Mion, Zinn, Macpeak & Seas, PLLC

[57] ABSTRACT

A vehicular lamp capable of ensuring adequate adhesiveness between the lamp body and the lens and airtightness in a lamp space as well as attractive appearance when a lamp is turned on, and reducing the non-radiating portion of the lens as much as possible. The vehicular lamp comprises a mounting means 17 provided on the extended section 15 of the lens 3 formed along the peripheral edge of the lens such that the projection 18 extending toward the center of the lens and an insert 19 contiguous to the projection are substantially L-shaped in cross section, and the mounting means 10 of the lamp body 2 corresponding to the extended section of the lens comprises the mounting groove 11, which is substantially C-shaped in cross section and into which the insert on the lens is adapted to be inserted, and a portion 12 contiguous to an open edge of the mounting groove and facing the projection on the lens.

2 Claims, 3 Drawing Sheets

VEHICULAR LAMP

BACKGROUND OF THE INVENTION

1. Field of the Invention

The invention relates to a technique which adequately ensures the sealing quality at a joint between a lens and a lamp body and makes a mounting groove shallow, to thereby reduce the non-radiating portion of the lens to achieve an attractive appearance and eliminate optical waste.

2. Description of the Related Art

In vehicular lamps, the mounting means for mounting the lens on the lamp body and join them together generally comprises a mounting groove formed on the lamp body and a rib formed on the lens. A sealing material having adhesiveness and a sealing property is interposed between the mounting groove and the rib such that they are fitted and secured to each other.

By way of example, a vehicular lamp a comprises, as shown in FIG. 4, a container-shaped lamp body b opened forward and laterally, and a lens c covering the opening of the lamp body b.

The lamp body b has a mounting groove d formed along a open edge thereof, and the lens c has a rib e formed along a respective peripheral edge thereof. The rib e is inserted into the mounting groove d. In addition, the sealing material f is filled between the mounting groove d and the rib e to secure the lamp body b and the lens c to each other and to fill up the gap therebetween, thus closing the lamp space defined by the lens and the lamp body.

With a prior vehicular lamp a shown in FIG. 4, in order to ensure adequate adhesiveness between the lamp body b and the lens c and keep airtightness in a lamp space, it is required that the lamp body b and the lens c be adhered to each other over at least a certain area. More specifically, the mounting groove d and the rib e must have at least a certain magnitude, so that a section g (referred hereinbelow as "extended section") of the lens, which extends laterally, poses a problem when the vehicular lamp a is put on. Here, light from a light source is intercepted by the mounting groove d, the rib e and the sealing material f to produce a non-radiating, dark portion h (a non-radiating portion) to impair the appearance, and a region of the lens c corresponding to the non-radiating portion h is an optically wasted region.

SUMMARY OF THE INVENTION

Thus the present invention aims at ensuring adequate adhesiveness between the lamp body and the lens and keeping airtightness in a lamp space as well as achieve an attractive appearance when the lamp is turned on. Further, the invention reduces the region where the lens is made optically waste. That is, the non-radiating portion is reduced as much as possible.

To solve the above-mentioned problem, the invention provides a vehicular lamp, in which the mounting means provided on the extended section of the lens is formed along a peripheral edge of the lens such that a projection extends inward toward the main lamp body and an insert contiguous to the projection are attached such that they are substantially L-shaped in cross section, and the mounting means of the lamp body corresponding to the extended section of the lens comprises a mounting groove, which is substantially C-shaped in cross section and into which the insert on the lens is adapted to be inserted, and the portion contiguous to the open edge of the mounting groove and facing the projection on the lens.

Accordingly, the projection on the mounting means faces the portion of the lamp body, and such portion is used to join the lamp body and the lens together, so that an adequate joint quality can be maintained between the lamp body and the lens even if the mounting groove is made shallow.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
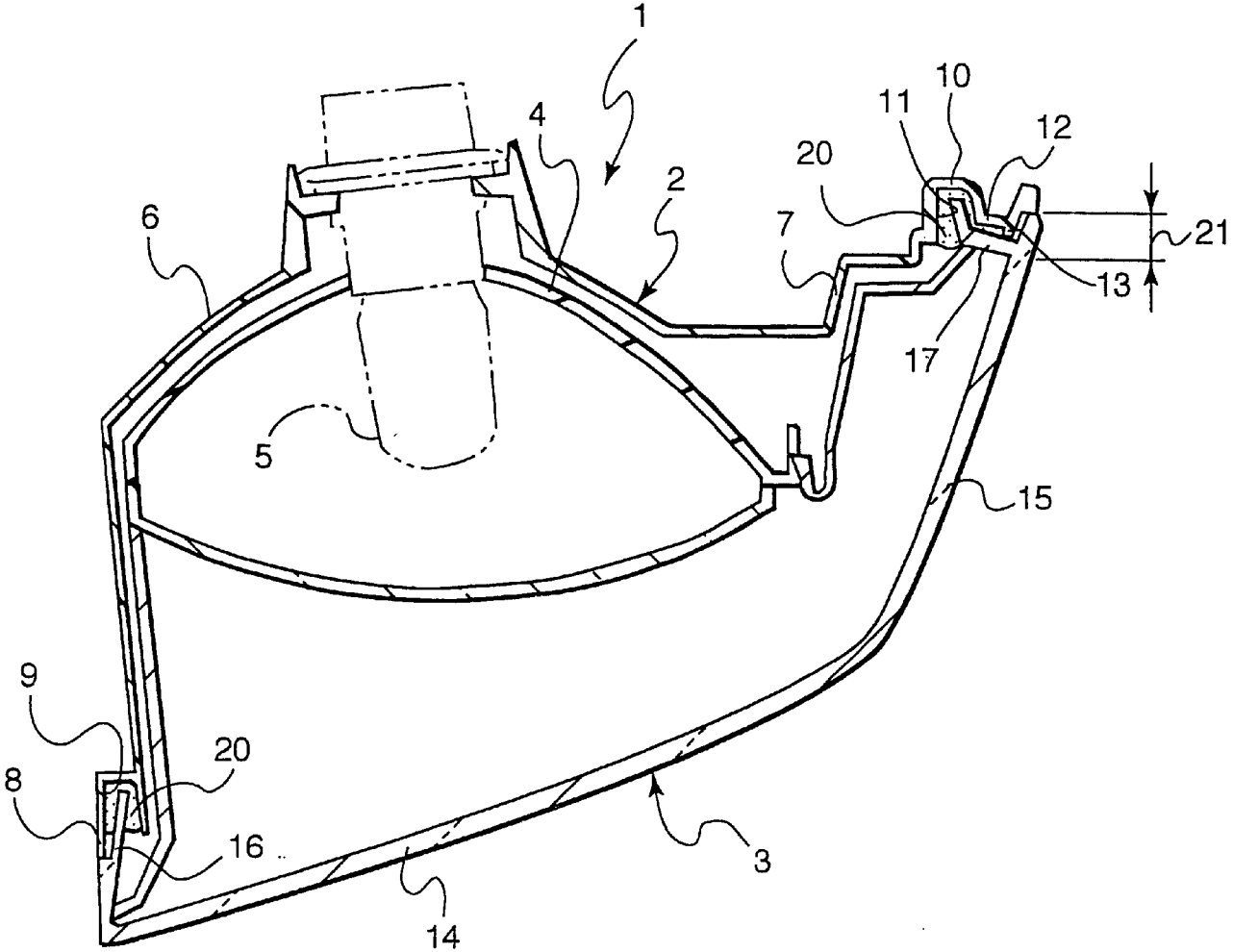
FIG. 1 together with FIGS. 2 and 3 shows in horizontal cross section an embodiment of the vehicular lamp according to the invention.

An embodiment of the vehicular lamp according to the invention will be described hereinbelow with reference to the accompanying drawings. Further, the embodiment discussed below is an application of the vehicular lamp, according to the invention, to a turn signal lamp 1 which is the marker lamp for automobiles.

The turn signal lamp 1 comprises a lamp body 2 opened forward and sideward, a lens 3 arranged to cover an opening of the lamp body 2, a reflector 4 provided inside the lamp body 2, a light source bulb 5 provided in a predetermined position on the lamp body 2, and so on.

The lamp body 2 comprises, as shown in cross section in FIG. 1, a main body 6 curved to assume the same configuration of that of the reflector 4, a side portion 7 projecting to a side of the main body 6, and a mounting means 8 (only a portion thereof shown) formed at an open edge of the lamp body opposite of the side portion 7 described hereinbelow, the mounting means having a mounting groove 9 which is substantially C-shaped to be opened forward so as to join the lens 3.

A vertically extending mounting means 10 is formed at the open edge of the side portion 7 on the lamp body 2.

Figure 3:
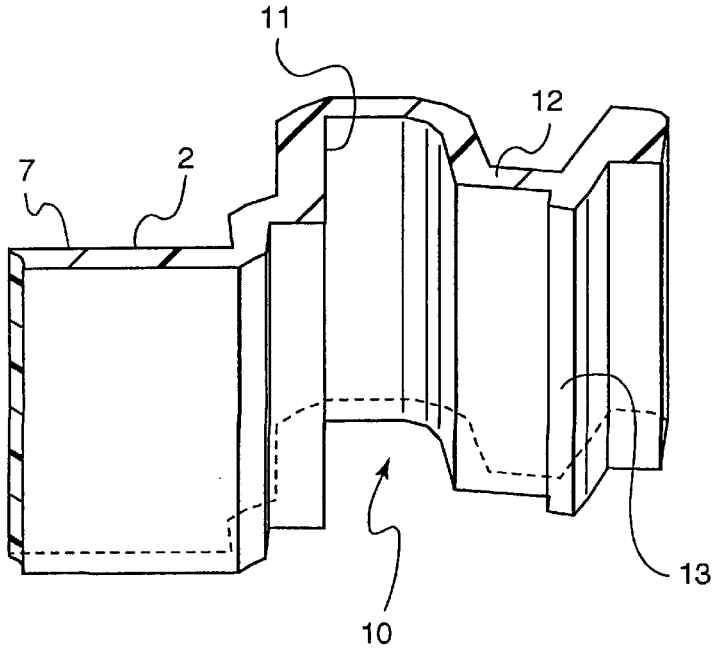
FIG. 3 is a perspective view showing a portion of the lamp body mounting means in enlarged scale.
Figure 4:
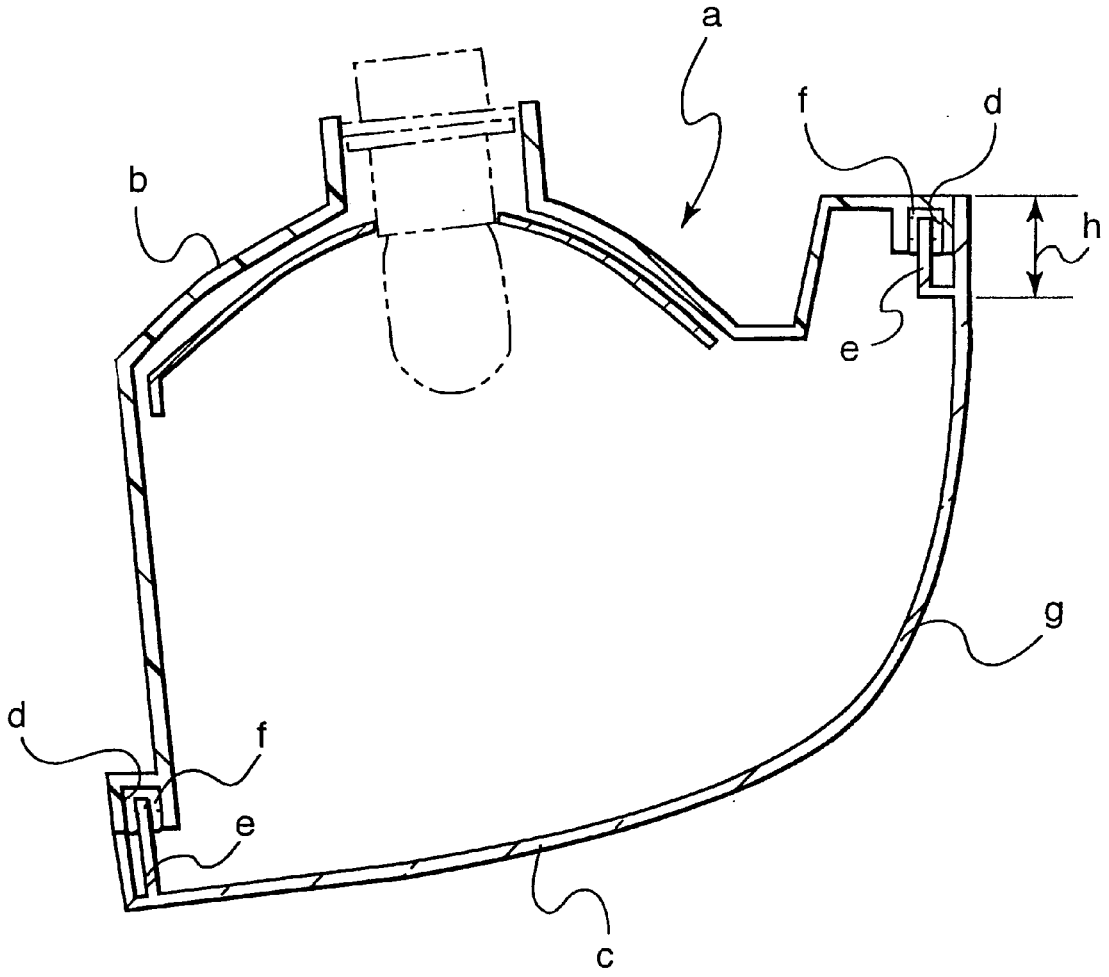
Fig. 4 Prior Art
FIG. 4 shows in horizontal cross section an example of a prior vehicular lamp.

Like the mounting groove 9, the mounting means 10 comprises a mounting groove 11 opened forward, and a projection 12 formed further outward on the side of the mounting groove 11 to protrude sideward in substantially L-shaped configuration, as shown in FIG. 3. A vertically extending ridge 13 is formed on the projection 12 to project forward therefrom.

The mounting groove 11 is formed to be somewhat shallower than the mounting groove 9, which is formed on the opposite portion of the lamp body 2. Also, the mounting means 10 is configured not to prevent extraction of the metal mold when the lamp body 2 is formed.

The lens 3 is structured such that a main section 14 extending substantially right and left is formed integrally with an extended section 15 which is extended obliquely rearwardly from the end of the main section 14. Further, a first lens mounting means 16 (only a portion thereof shown) substantially in the form of a rib is formed opposite of the extended section 15 described hereinbelow to extend substantially rearward from a peripheral edge of the lens 3.

Figure 2:
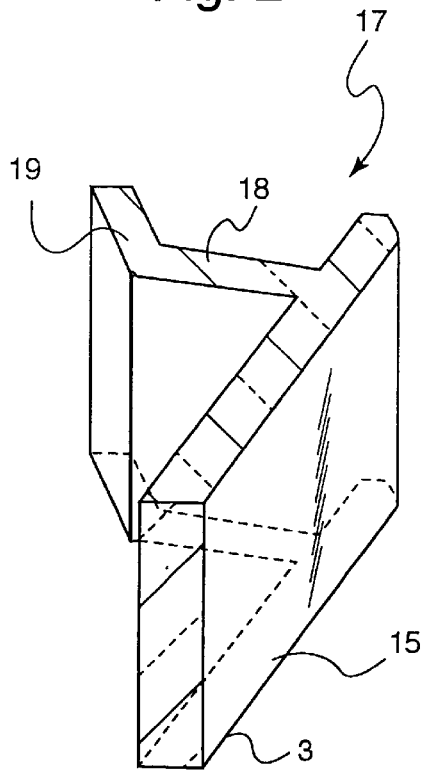
FIG. 2 is a perspective view showing a portion of the lens mounting means in enlarged scale.

A second lens mounting means 17 is formed on the edge on the of the extended section 15 to extend inwardly toward the main body. The second lens mounting means 17 comprises, as shown in FIG. 2, the projection 18 extending inward from extended section 15, and an insert rib 19 contiguous to the end of the projection 18 to extend substantially rearward; the mounting means 17 being generally L-shaped in cross section. The extent, by which the insert rib 19 extends rearward of the lens 3, is fairly smaller than that of the first lens mounting means 16.

Since the first lens mounting means 16 and the insert 19 on the mounting means 17 project substantially rearward as described above, mounting of the lens 3 to the lamp body 2 is effected in such a manner that rearward movement of the lens 3 relative to the lamp body 2 causes the first lens mounting means 16 and the insert rib 19 of the mounting second lens means 17, respectively, to be inserted into the mounting grooves 9 and 11 of the lamp body 2, as described hereinbelow in detail.

Although no reference numerals are given and no explanation made, an inner lens, extension and the like are provided in respective predetermined positions in front of the reflector 4 or along the inner surface thereof within the lamp body 2.

As shown in FIG. 1, the mounting means 8 on the lamp body 2 and the first lens mounting means 16 on the lens 3 are essentially constructed such that the first lens mounting means 16 is inserted into the mounting groove 9 and a seal material 20 having adhesiveness and a sealing property is interposed between the mounting groove 9 and the first lens mounting means 16 so as to fill the gap therebetween, so that the adhesive action of the seal material 20 causes the lens 3 to be secured to the lamp body 2.

When the lens 3 is mounted on the lamp body 2, securement of the lens 3 to the lamp body 2 is effected at the opposite end of the turn signal lamp 1 in a somewhat different manner.

Thus, when the insert rib 19 on the second lens mounting means 17 is inserted into the mounting groove 11 as shown in FIG. 1, a front surface 12*a* of the projection 12 on the lamp body 2 is caused to face a rear surface 18*a* of the projection 18 on the lens 3. At this time, a ridge 13 on the lamp body 2 is caused to be spaced between the rear surface 18*a* and front surface 12A.

At this time, the seal material 20 is received in the mounting groove 11 and interposed between the projection 12 on the lamp body 2 and the projection 18 on the lens 3 while it is intercepted by the ridge 13 to be prevented from swelling out from between the lens 3 and the lamp body 2. In this manner, the sealing material makes the lens 3 and the lamp body 2 adhere to each other and fills up the gap therebetween to close a lamp space defined by the lamp body 2 and the lens 3.

On the side portion 7 on the lamp body 2 associated with the extended section 15 on the lens 3 in the turn signal lamp 1, the lens 3 is mounted on the lamp body 2 by means of the lens mounting groove 11, which is shallower than the mounting groove 9, and the insert rib 19 which extends rearward to a smaller extent, so that it is possible to significantly reduce a magnitude of a non-radiating portion 21, which does not permit light from the light source bulb to radiate outside of the lens 3, as compared with the prior art. Moreover, an effect equivalent to or over the prior art can be obtained in adhering condition of the lens 3 and the lamp body 2 since the seal material 20 is interposed between the projection 12 on the lamp body 2 and the projection 18 on the lens 3, both of which face each other, to join them.

As apparent from the above, the vehicular lamp according to the invention is constructed such that the second lens mounting means 17 provided on the extended section 15 of the lens 3 is formed along the peripheral edge of the lens 3 such that the projection 18 extending from the lens 3 and the insert rib 19 contiguous to the projection 18 are substantially L-shaped in cross section, and the mounting means 10 of the lamp body 2 corresponding to the extended section 15 of the lens 3 comprises the mounting groove 11, which is substantially C-shaped in cross section and into which the insert rib 19 on the lens 3 is adapted to be inserted, and the portion contiguous to the open edge of the mounting groove 11 and facing the projection on the lens. Accordingly, the vehicular lamp can ensure adequate adhesiveness between the lamp body and the lens and keep airtightness in the lamp space as well as reduce the non-radiating portion defined by that portion-of the extended section on the lens, which is mounted to the lamp body, for an attractive appearance.

Also, according to the invention, a ridge is formed on that portion of the lamp body, which faces the projection on the lens, and so can prevent the sealing material from swelling out to impair the appearance.

In addition, concrete configurations and structures of the respective parts disclosed in the above embodiment are only exemplary in embodying the invention, and should not be interpreted to limit the technical scope of the invention.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A vehicular lamp apparatus for reducing optical waste comprising:

a lamp body having an opening for receiving a reflector and a light bulb, said lamp body having a side portion projecting laterally to one side;

a lens for covering and sealing said opening, said lens having an extended portion corresponding to said side portion of the lamp body, wherein the lens, including the extended portion, has an inner side and an outer side; and mounting means for fixing said lens to said lamp body, such that the lens covers and seals the opening and optical waste is reduced, wherein said mounting means comprises:

a lens mounting means having a projection formed along a peripheral edge of said extended portion of the lens, said projection extending from the inner side of and substantially perpendicular to the extended portion of said lens, and an insert rib angularly attached to an end of said projection such that said projection and said insert rib are substantially L-shaped in cross section; and a mounting groove formed on an end of said side portion of the lamp body, which is substantially C-shaped in cross section, said mounting groove for receiving said insert rib of said lens mounting means, wherein an outer lip of said mounting groove is adjacent to said projection of said lens mounting means.

2. The vehicular lamp apparatus according to claim 1, wherein said mounting means further comprises a ridge formed on said outer lip of said mounting groove for providing space between said outer lip and the adjacent projection of the lens mounting means.

* * * * *